US006029937A

United States Patent [19]

Funaro

[11] Patent Number: 6,029,937

[45] Date of Patent: Feb. 29, 2000

[54] FLORAL STAND WITH INTERCHANGEABLE COMPONENTS

[76] Inventor: Kevin J. Funaro, 3115 SW. 40th St., Des Moines, Iowa 50321

[21] Appl. No.: 09/122,081

[22] Filed: Jul. 23, 1998

[51] Int. Cl.[7] ..... A47G 7/00

[52] U.S. Cl. ..... 248/146; 248/910; 47/39

[58] Field of Search ..... 248/146, 127, 248/158, 159, 311.2, 910, 527; 47/39

[56] References Cited

U.S. PATENT DOCUMENTS

| | | | |
|---|---|---|---|
| 905,627 | 12/1908 | Astruck | 248/910 X |
| 1,401,057 | 12/1921 | Elliott | 108/101 |
| 1,877,098 | 9/1932 | Washburn | 248/146 |
| 1,928,799 | 10/1933 | Stevens | 47/39 |
| 2,861,764 | 11/1958 | Fisher | 248/146 |
| 3,232,567 | 2/1966 | Mastenbrook | 47/40.5 |
| 3,332,652 | 7/1967 | Oaks | 248/146 |
| 4,244,147 | 1/1981 | Geddes | 47/39 |
| 4,359,786 | 11/1982 | Rosberg et al. | 248/910 X |
| 5,199,213 | 4/1993 | Krebs et al. | 47/39 |
| 5,438,797 | 8/1995 | Lendel | 47/82 |
| 5,460,353 | 10/1995 | Rittenhouse | 256/1 |
| 5,577,344 | 11/1996 | Zarembra et al. | 47/39 |
| 5,685,343 | 11/1997 | Smith | 138/39 |
| 5,718,178 | 2/1998 | Smith | 108/25 |

FOREIGN PATENT DOCUMENTS

| | | | |
|---|---|---|---|
| 1022512 | 3/1966 | United Kingdom | 248/159 |

*Primary Examiner*—Anita M. King
*Attorney, Agent, or Firm*—Zarley, McKee, Thomte, Voorhees & Sease

[57] ABSTRACT

A flower or candle stand is provided with multiple interchangeable components which are threadably coupled together for quick and easy assembly and disassembly. The stand is adapted to hold a single flower bud, a floral arrangement, or one or more candles. The stand generally includes a hollow pedestal which can filled with water or other ballast material. A coupler is threadably mounted on the pedestal, and a holder or container is threadably mounted on top of the coupler. The bottom of the holder is smooth such that the holder can sit upon a table when removed from the coupler. Optional extension stems may be provided to increase the height of the stand. An enlarged base may also be threadably coupled to the bottom of the pedestal to provide additional stability.

20 Claims, 4 Drawing Sheets

FLORAL STAND WITH INTERCHANGEABLE COMPONENTS

BACKGROUND OF THE INVENTION

Plant and flower stands are well-known for use in supporting plants and floral arrangements above a table or floor. Typically, such stands are constructed of metal or other heavy material for stability. Lightweight plastics have also been used, but the lack of weight or ballast in such plastic stands limits the height thereof.

It is also known to construct such plant and flower stands with multiple components which can be assembled and disassembled for shipping, storage and transportation. However, such multiple-component stands normally only assume one configuration and do not have interchangeable components.

Accordingly, a primary objective of the present invention is the provision of an improved flower stand.

Another objective of the present invention is the provision of an flower stand kit having multiple interchangeable components which can be assembled in various configurations.

Another objective of the present invention is the provision of a flower stand including a hollow pedestal for holding water or ballast.

Another objective of the present invention is the provision of a stand having an interchangeable top holder for a flower bud, a floral arrangement, or a candelabra.

A further objective of the present invention is the provision of a lightweight plastic flower stand which is economical to manufacture, easy to assemble, stable and durable in use, and attractive in appearance.

These and other objectives will become apparent from the following description of the invention.

SUMMARY OF THE INVENTION

This invention relates to a stand for holding a flower, floral arrangement, or one or more candles. The stand includes a hollow pedestal having an internal cavity which can be filled with water or ballast material. A coupler threadably mounts onto the pedestal, with a holder for the flowers or candles being threaded onto the coupler. Various sized and shaped holders can be interchanged with one another. Extension stems may also be added to increase the height of the stand. An enlarged base may be connected to the bottom of the pedestal to provide extra stability. The stand is constructed from lightweight plastic and can be quickly and easily assembled and disassembled for transportation, storage or shipping.

DETAILED DESCRIPTION OF THE DRAWINGS

Figure 1:
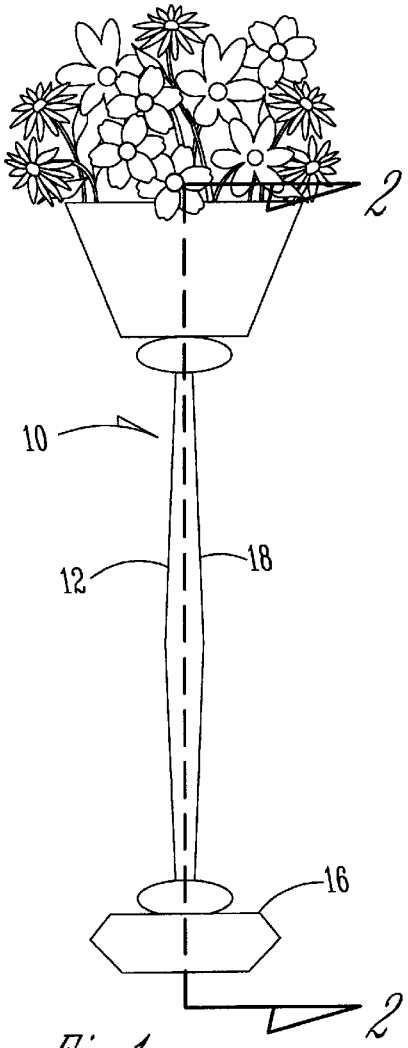
FIG. 1 is a side elevation view of the stand of the present invention.
Figure 2:
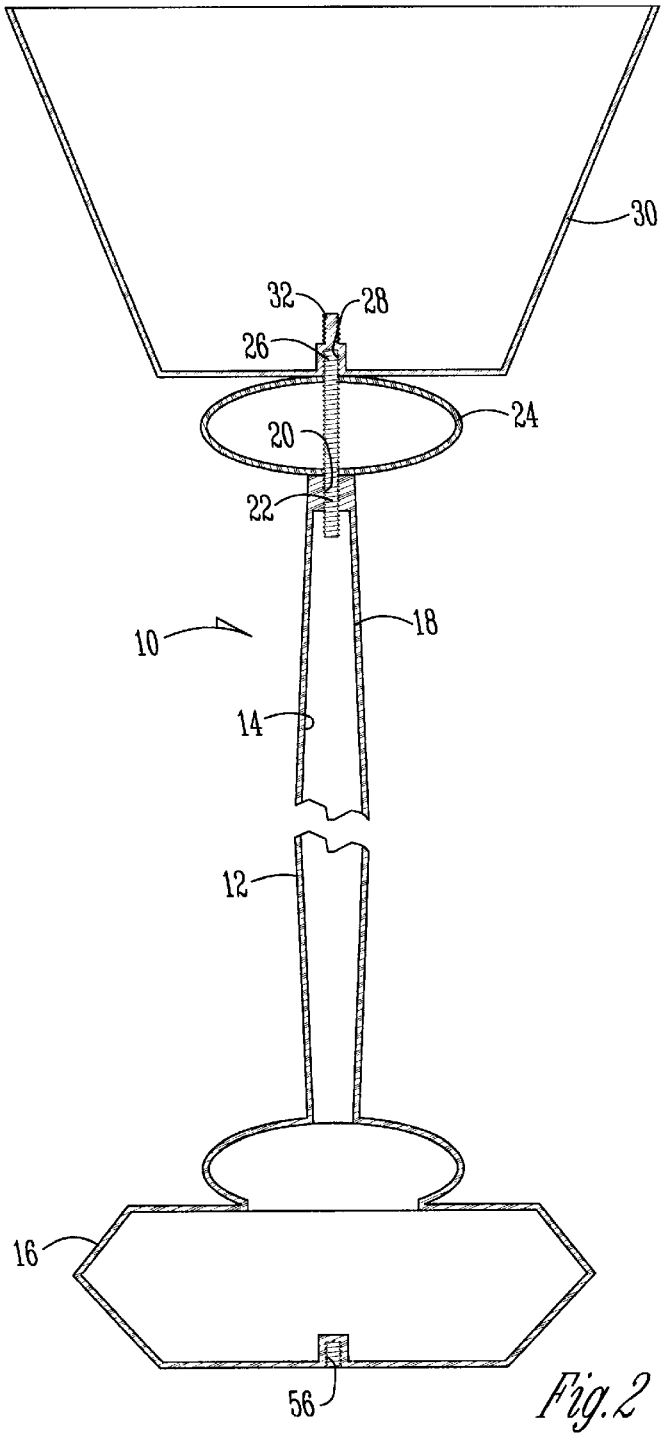
FIG. 2 is a sectional view taken along aligns 2—2 of FIG. 1.

As shown in FIGS. 1–2, the stand of the present invention is generally designated by the reference numeral 10. The stand 10 is adapted to hold a flower bud, a floral arrangement, or one or more candles. The stand 10 includes a hollow pedestal 12 having an internal cavity 14. The pedestal includes an enlarged lower portion 16 and an upstanding stem 18 with an opening 20 at the upper end through which water or other ballast material may be added to the cavity 14 to provide stability for the stand 10.

Figure 6:
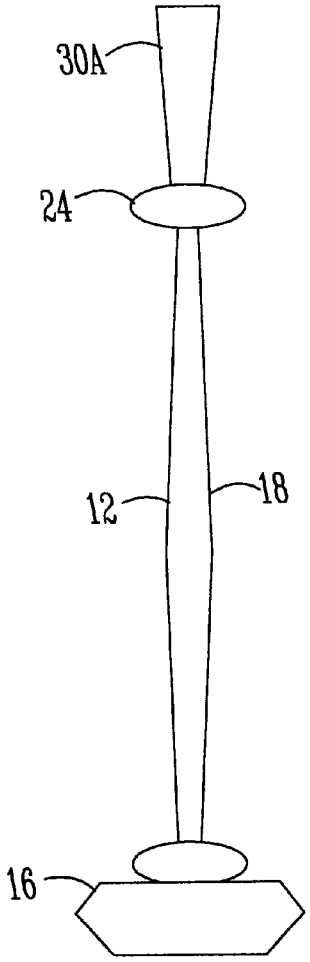
FIG. 6 is a side elevation view of still another embodiment of the stand.
Figure 7:
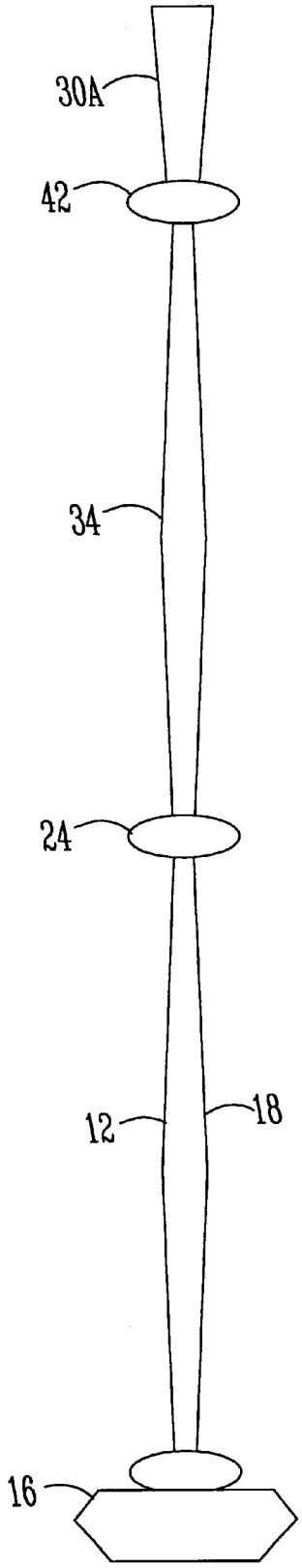
FIG. 7 is a side elevation view of a further embodiment of the stand.

The opening 20 in the upper end of the stem 18 is threaded so as to receive a threaded stud 22 on a coupler 24. The coupler 24 also has an upper threaded stud 26 which is adapted to be received in a female threaded aperture 28 on the lower side of a container or holder 30. The holder 30 may be interchanged with different sized and/or shaped holders to accommodate different floral arrangements or candles and to provide a different appearance for the stand 10. For example, a bud vase 30A may be mounted on the upper stud 26 of the coupler 24, is shown in FIG. 6. Another alternative holder which may be mounted on the coupler 28 is a votive cup or bowl, a topiary bowl, a jardiniere, an oasis holder, or a bridesmaid cage for holding a bouquet. Each of these alternative holders includes a smooth flat bottom such that the holder can be removed from the coupler 24 such that a guest at a banquet or convention can take the holder with the floral arrangement home and such that the holder can be set upon a table or other support surface without use of the pedestal 12.

Figure 3:
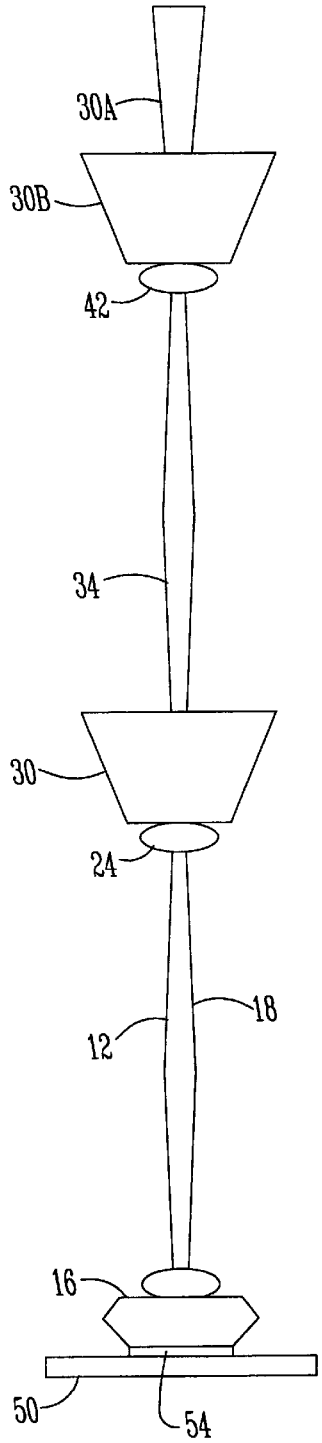
FIG. 3 is a side elevation view of an alternative embodiment of the stand having an extension stem with an additional holder for flowers or candles.
Figure 4:
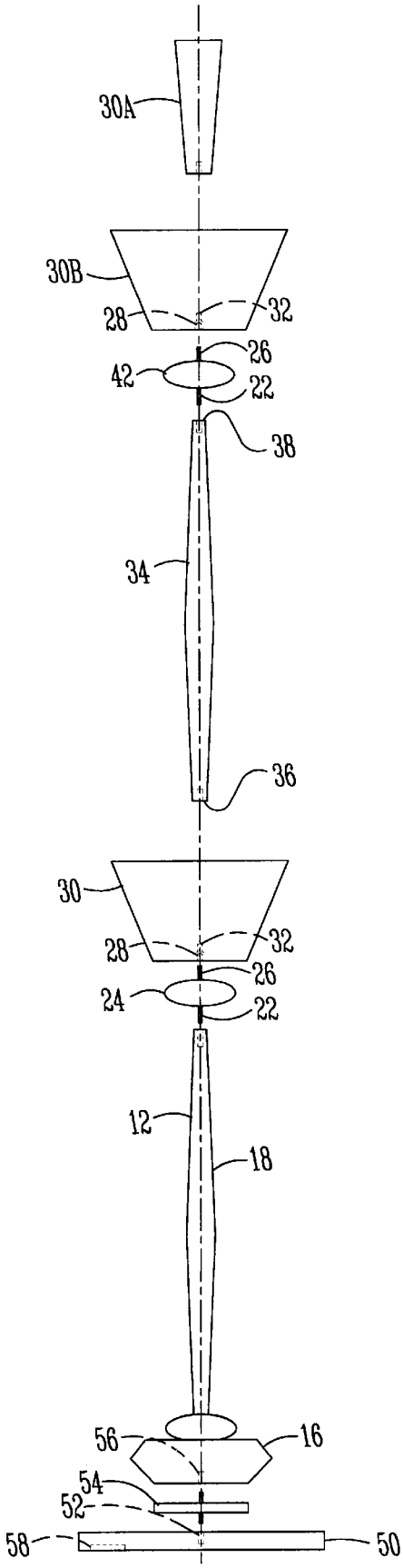
FIG. 4 is an exploded view of the stand shown in FIG. 3.

Preferably, the holder 30, and each alternative embodiment thereof, includes a centrally located male stud 32 extending upwardly from the bottom of the holder. An extension stem 34 having a lower female threaded aperture 36 may be threadably mounted on the male stud 32, as shown in FIGS. 3 and 4. A second coupler 42, having a similar construction to the coupler 24 is threadably received on the top female aperture 38 of the extension stem 34, and adapted to threadably receive a second holder 30B. Another holder, such as a bud vase or candle holder 30A may be threadably mounted on the male stud 36 of the second holder 30B, as shown in FIG. 4.

An enlarged base 50 may be provided when the stand 10 is extended to increased heights, as shown in FIGS. 3 and 4. The base 50 includes a threaded female aperture 52 for receiving a threaded coupler 54, which in turn is threadably received in a threaded female aperture 56 in the bottom of the pedestal 12. Preferably, the coupler 54 has a flat profile. The base 50 preferably is hollow and includes a removable plug 58 such that sand or other ballast material may be added to the base 50 for increased stability.

Figure 5:
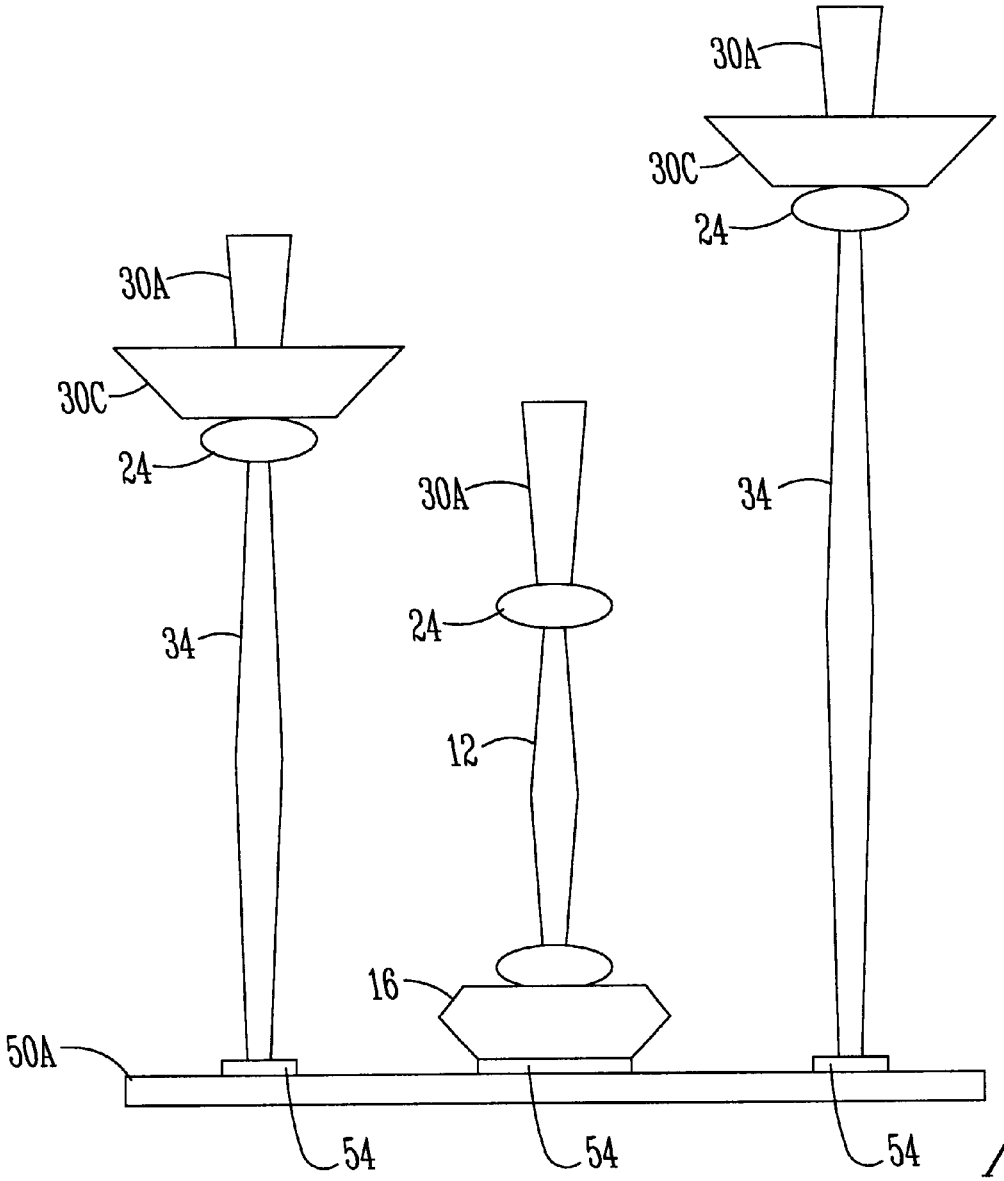
FIG. 5 is a side elevation view of another alternative stand in accordance with the present invention.

Another alternative embodiment is shown in FIG. 5. In this embodiment, a base 50A having a construction similar to base 50, is provided with multiple apertures so as to support one or more pedestals 12, as well as one or more extension stems 34, which may have different heights and shapes. The coupler 54 is utilized to securely connect each pedestal 12 and/or extension stem 34 to the base 58. Either the same or different holders 30 such as bud vase 30A or shallow bowl 30C, may be used to selectively create the desired appearance. Also, an additional extension stem 34 may be used to increase the height to provide multiple tiers of holders 30.

The various components of the stand 10, including the pedestal 12, the holders 30, 30A, 30B, the couplers 24, 42, 54, the extension stems 34, and the bases 50, 58 may be packaged as a kit so that the florist can selectively create different designs for different purposes. For example, shorter stands can be used on tables, while extended height stands can be used on the floor. Also, the stand can be modified for use in holding a single bud, a single candle, multiple candles, or various floral arrangements. A single flower bud may also be used in the pedestal 12 alone, without the use of a bud vase holder, by inserting the stem of the bud into the upper opening 20, and with the pedestal 20 being filled with water for the bud.

Preferably, each of the components of the stand is made of a lightweight plastic. The components can be quickly and easily assembled and disassembled for storage, transportation and shipping. The couplers provide a secure internal interlocking connection for the pedestal 12, the holders 30, the extension stems 40, and the bases 50, 58. It is understood that the exterior shape of these components may be varied from that shown in the drawings so as to provide additional options for the florist.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A stand for holding a flower, floral arrangement or candle, comprising:

a hollow pedestal having an internal cavity with an upper opening through which water or ballast may be added to the cavity;

a first coupler having a lower stud removably mountable in the opening of the pedestal to close the cavity and having an upper stud;

an extension stem mounted on the first coupler, the extension stem having a lower end with a recess for receiving the upper stud of the first coupler and an upper end with a recess;

a second coupler having a lower stud received in the recess of the upper end of the extension stem and an upper stud; and a first holder mounted on the second coupler for holding the flower, floral arrangement or candle, the holder having a bottom with a recess for receiving the upper stud of the second coupler such that the holder is removably mountable onto the second coupler.

2. The stand of claim 1 wherein the opening of the pedestal and the recess of the holder are each threaded, and the studs of the first coupler are each threaded, such that the first coupler is threadably secured to the pedestal and to the extension stem.

3. The stand of claim 1 wherein the pedestal includes an enlarged lower portion and an upstanding stem with an upper end, the opening of the pedestal being at the upper end of the stem.

4. The stand of claim 1 wherein the bottom of the holder is smooth such that the holder rests level on a support surface when removed from the second coupler.

5. The stand of claim 1 wherein the holder is selected from a bud vase, a flower bowl, and a candle holder.

6. The stand of claim 1 wherein the first holder includes a male stud extending upwardly from within the first holder, and further comprising a second holder for a flower, floral arrangement or candle, the second holder having a bottom with a recess for receiving the upper stud of the first holder such that the second holder is removably mounted on the first holder.

7. The stand of claim 6 further comprising the extension stem positioned between the first and second holders.

8. The stand of claim 1 further comprising an enlarged base secured to the pedestal to enhance stability.

9. The stand of claim 8 wherein the base is hollow and has a removable plug to allow ballast to be added into the base.

10. The stand of claim 8 wherein the base includes an upper recess, the pedestal includes a bottom with a recess therein, and further comprising a third coupler with a lower stud received in the recess of the base and an upper stud received in the recess in the bottom of the pedestal.

11. A stand for holding a flower, floral arrangement or candle, comprising:

a hollow pedestal having an internal cavity with an upper opening through which water or ballast may be added to the cavity;

a first coupler having a lower stud removably mountable in the opening of the pedestal to close the cavity and having an upper stud;

a first holder for the flower, floral arrangement or candle, the holder having a bottom with a recess for receiving the upper stud of the first coupler such that the holder is removably mountable onto the first coupler, and having an upwardly extending stud;

a second holder for a second flower, floral arrangement or candle, the second holder having a bottom with a recess for receiving the upper stud of the first holder such that the second holder is removably mounted on the first holder; and the pedestal and the recess of the first holder each being threaded and the studs of the first coupler each being threaded, such that the first coupler is threadably secured to the pedestal and to the first holder.

12. The stand of claim 11 wherein the pedestal includes an enlarged lower portion and an upstanding stem with an upper end, the opening of the pedestal being at the upper end of the stem.

13. The stand of claim 11 wherein the bottom of the first holder is smooth such that the first holder rests level on a support surface when removed from the first coupler.

14. The stand of claim 11 wherein the second holder is selected from a bud vase, a flower bowl, and a candle holder.

15. The stand of claim 11 further including an extension stem positioned between the first coupler and the first holder.

16. The stand of claim 15 wherein the extension stem has a lower end with a recess for receiving the upper stud of the first coupler and an upper end with a recess, and further comprising a second coupler having a lower stud received in the recess of the upper end of the extension stem and an upper stud receivable in the recess in the bottom of the second holder.

17. The stand of claim 11 further comprising an extension stem positioned between the first and second holders.

18. The stand of claim 11 further comprising an enlarged base secured to the pedestal to enhance stability.

19. The stand of claim 18 wherein the base is hollow and has a removable plug to allow ballast to be added into the base.

20. The stand of claim 18 wherein the base includes an upper recess, the pedestal includes a bottom with a recess therein, and further comprising a second coupler with a lower stud received in the recess of the base and an upper stud received in the recess in the bottom of the pedestal.

* * * * *